US007094166B2

(12) United States Patent
Beane

(10) Patent No.: US 7,094,166 B2
(45) Date of Patent: Aug. 22, 2006

(54) SNAPPING BASKETBALL NET

(76) Inventor: Delance Beane, 3357 Aspen Dr., Apt. 5212, Lake Orion, MI (US) 48359

( * ) Notice: Subject to any disclaimer, the term of this patent is extended or adjusted under 35 U.S.C. 154(b) by 0 days.

(21) Appl. No.: 11/081,117

(22) Filed: Mar. 16, 2005

(65) Prior Publication Data

US 2005/0221921 A1 Oct. 6, 2005

Related U.S. Application Data

(60) Provisional application No. 60/559,136, filed on Apr. 2, 2004.

(51) Int. Cl.
*A63B 63/08* (2006.01)

(52) U.S. Cl. ..... 473/485; D21/701

(58) Field of Classification Search ..... 473/489, 473/433, 449, 447, 448, 486, 487, 485; D21/702, D21/703, 705, 701
See application file for complete search history.

(56) References Cited

U.S. PATENT DOCUMENTS

| | | | | | |
|---|---|---|---|---|---|
| 2,199,609 | A * | 5/1940 | Bennett | 473/485 |
| 4,351,166 | A * | 9/1982 | Belin | 63/15 |
| 4,877,241 | A * | 10/1989 | Rothbard | 473/485 |
| 5,458,325 | A * | 10/1995 | Klein et al. | 473/485 |
| D397,384 | S * | 8/1998 | DeArmond | D21/701 |
| 5,944,623 | A * | 8/1999 | Schlicting | 473/489 |
| D431,620 | S | 10/2000 | Hill | |
| 6,652,396 | B1 | 11/2003 | McBride | |
| 6,746,349 | B1 * | 6/2004 | Neiberger et al. | 473/485 |

* cited by examiner

*Primary Examiner*—Eugene Kim
*Assistant Examiner*—M. Chambers
(74) *Attorney, Agent, or Firm*—Carlson, Gaskey & Olds

(57) ABSTRACT

A snapping basketball net includes a plurality of beads supported by a net material. The plurality of beads knock together in response to a basketball passing through the net material. A plurality of retainer members maintain the arrangement of the plurality of beads on the net material.

8 Claims, 3 Drawing Sheets

SNAPPING BASKETBALL NET

BACKGROUND OF THE INVENTION

This application claims priority to U.S. Provisional Patent Application Ser. No. 60/559,136 filed Apr. 2, 2004, and entitled "Snapping Basketball Net."

This invention generally relates to a basketball net which enhances the "swishing" sound that occurs when a basketball passes straight through the net.

Every basketball player and fan enjoys the "swishing" sound that accompanies a successful basketball shot. The "swish" sound often adds much excitement to the game, whether playing on a home basketball backboard system or in a gym competitively. The satisfaction a shooter gets by "swishing" a successful basketball shot can often be enough to boost that player's confidence and thereby increase their level of play. Also, the sound of a basketball shot that "swishes" through the net during a crucial moment of the game is greatly disheartening and intimidating to the opponent.

Accordingly, it is desirable to develop a basketball net that produces a more audible noise or snapping sound to enhance the "swish" effect that occurs when a player makes a perfect basketball shot.

SUMMARY OF THE INVENTION

The present invention is a snapping basketball net that produces a desired "swishing" sound when a basketball passes straight through the net.

The snapping basketball net of this invention includes a first net portion and a second net portion with a plurality of beads supported on the second net portion. As a basketball passes straight through the net, the second net portion expands and retracts thereby causing the beads to knock together. The plurality of beads produce the desired amplified sound.

In some forms of the invention, a banner logo is supported on at least one of the first net portion and the second net portion to allow for personalization of the snapping basketball net. A plurality of retainer members maintain the plurality of beads on the second net portion.

The snapping basketball net of the present invention provides an enhanced "swishing" sound that both players and fans enjoy and that is intimidating to opponents.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
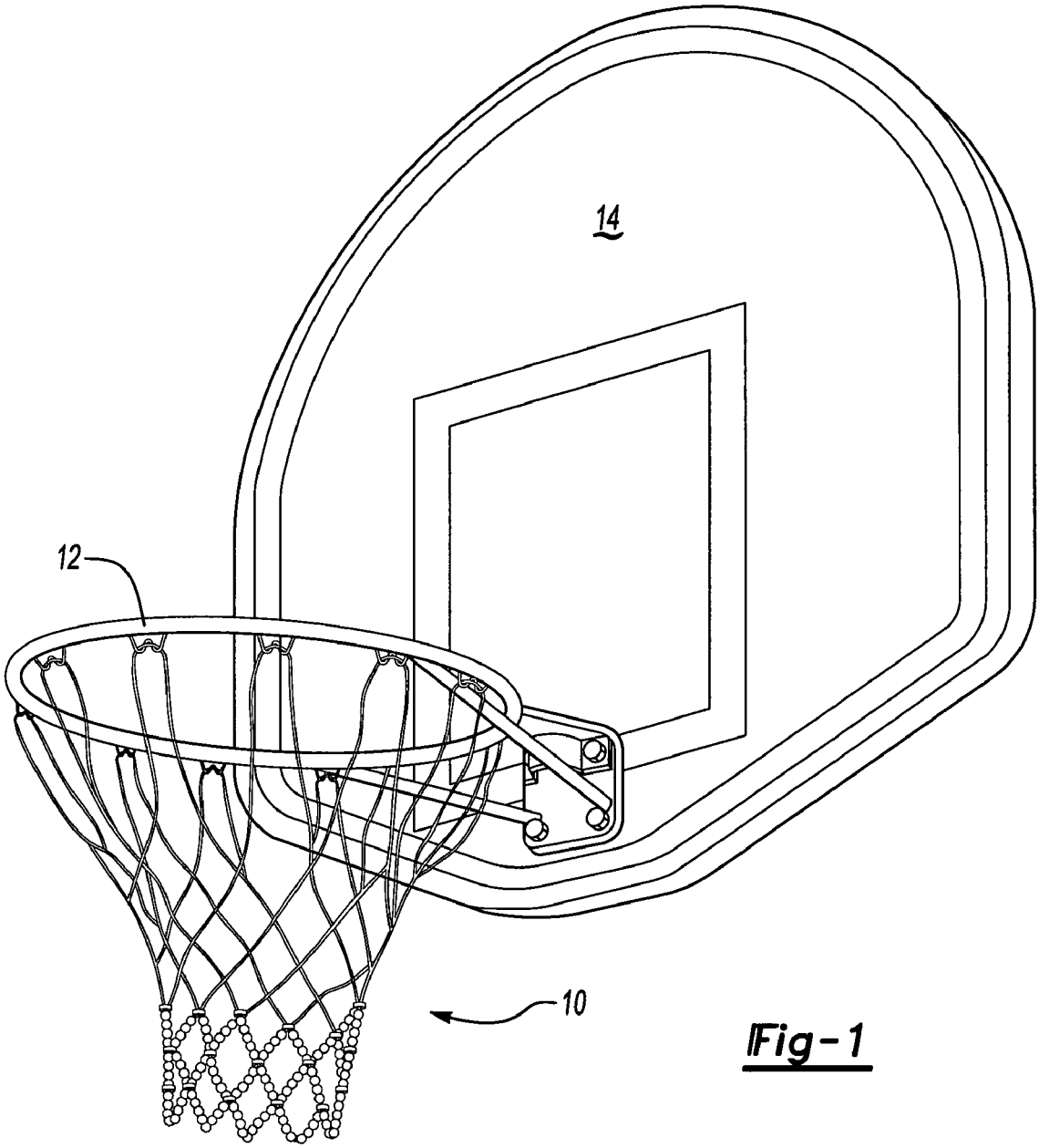
FIG. 1 is a perspective view of a basketball backboard system that includes a basketball net that creates an enhanced "swishing" sound according to this invention.

Referring to FIG. 1, a snapping basketball net 10 is attached to a conventional basketball rim 12. The basketball rim 12 is attached to a conventional basketball backboard 14 as known. The basketball rim 12 and the basketball backboard 14 can be of any configuration known in the art including but not limited to outdoor basketball backboard assemblies, indoor basketball backboard assemblies and miniature basketball backboard assemblies. The snapping basketball net 10 generates a desired sound in response to a basketball passing there through, as is further discussed below.

Figure 2:
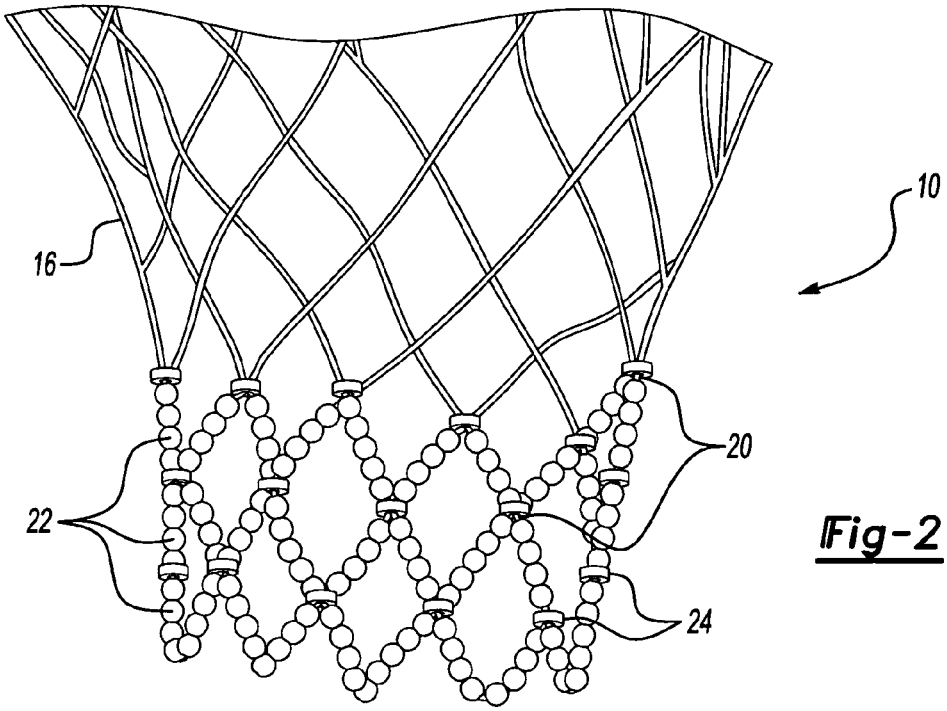
FIG. 2 is a partial front view of the basketball net according to this invention.
Figure 3:
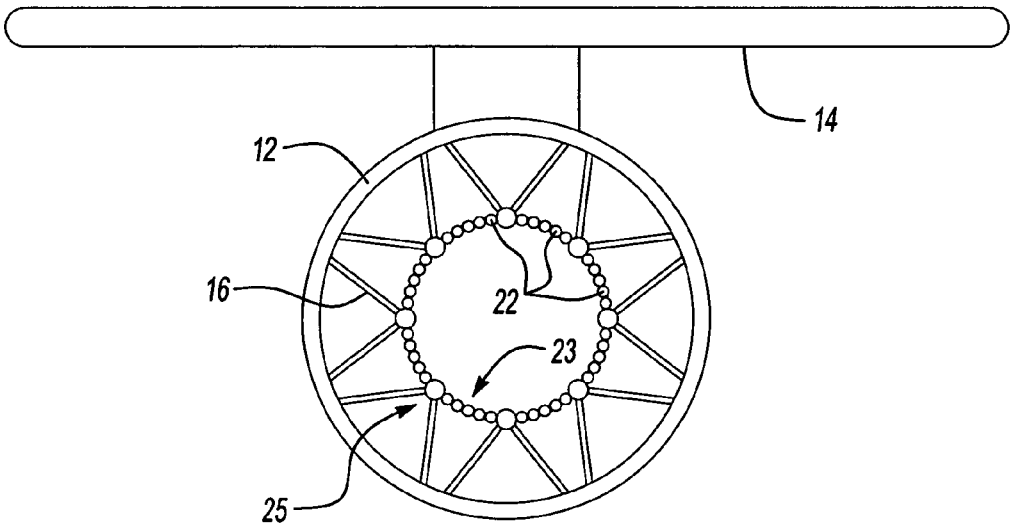
FIG. 3 is a top view of a basketball backboard system incorporating the basketball net according to this invention.

Referring to FIGS. 2 and 3, the snapping basketball net 10 includes a first net portion 16 and a second net portion 20 that is preferably a different material than the first net portion 16. Preferably, the first net portion 16 is a conventional net material such as nylon string or twine. The first net portion 16 is configured in a plurality of diamond shaped rows. The second net portion 20 is preferably made of an elastic material. Although an elastic material is disclosed, other materials are within the scope of this invention. The second net portion 20 is attached to a bottom edge of the first net portion 16. The first net portion 16 and the second net portion 20 may be of similar or varying colors and sizes.

The second net portion 20 is preferably fabricated of elastic cords and represents a small portion of the bottom half of the snapping basketball net 10. The second net portion 20 is arranged in the same diamond shaped rows as the first net portion 16. Preferably, the second net portion 20 comprises at least one diamond shaped row of the snapping basketball net 10.

A plurality of beads 22 are slideably supported on the second net portion 20. Although the plurality of beads 22 are shown, it is within the contemplation of this invention to use nickel plated beads, bells, or other materials known in the art as substitutes for the plurality of beads 22. The second net portion 20 is threaded through the plurality of beads 22 to define an inner perimeter 23 and an outer perimeter 25 of the snapping basketball net 10 (See FIG. 3). The plurality of beads 22 are preferably spherical. Although the spherical shape is preferred, any other shape is within the contemplation of this invention. Preferably, the plurality of beads 22 are made of plastic. It should be understood that the color and size of the plurality of beads 22 may vary. For example, the plurality of beads 22 may be arranged with a desired color scheme representing a favorite team's colors.

A plurality of retainer members 24 maintain the plurality of beads 22 in the diamond shaped rows and constrain the second net portion 20 to prevent bunching.

Thus, as a basketball passes through the first net portion 16 and subsequently comes into contact with the second net portion 20, the second net portion 20 expands and retracts thereby causing the plurality of beads 22 to knock together. The sound created by the plurality of beads 22 is more audible than a standard net and provides an intimidating "swish" sound that players and fans gain much satisfaction in hearing.

Figure 4:
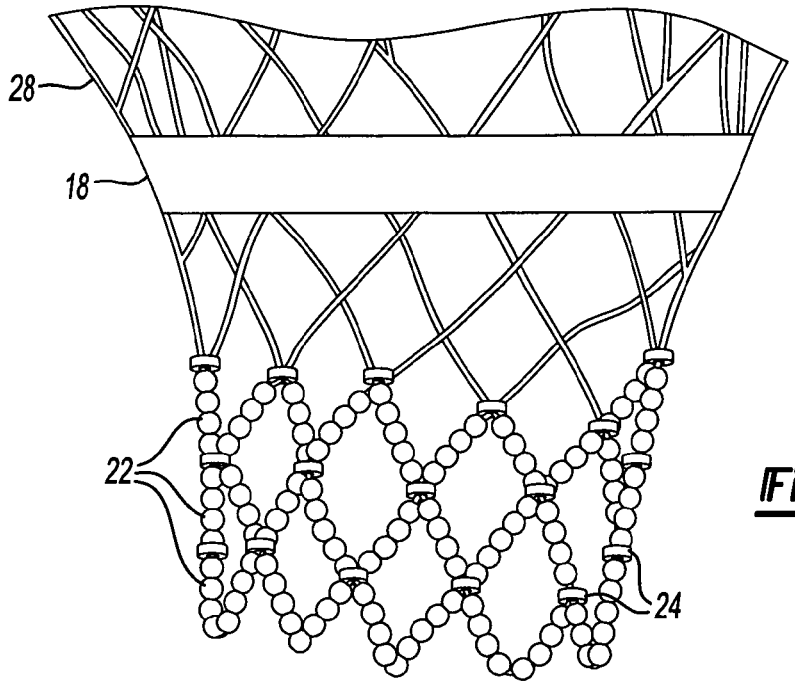
FIG. 4 is a partial front view of another example basketball net according to this invention.

Another example basketball net of the present invention is shown in FIG. 4. A plurality of beads 22 are supported on a first net portion 28 in much the same way as in the example shown in FIG. 2. In this example, however, multiple net materials are not utilized. Instead, the first net portion 28 is utilized to create the snapping basketball net 10.

A logo banner 18 may be included as part of the snapping basketball net 10. The logo banner 18 allows for personalization of the snapping basketball net 10 that could include team logos, player's names and the like. The logo banner 18 may also be coordinated with the plurality of beads 22 to create a specific color scheme. For example, the colors and symbols of a particular team may be embodied in the plurality of beads 22 and the logo banner 18. It is contemplated that the logo banner 18 be fabricated of any material known to one skilled in the art. The logo banner 18 is supported on the first net portion 28.

Figure 5:
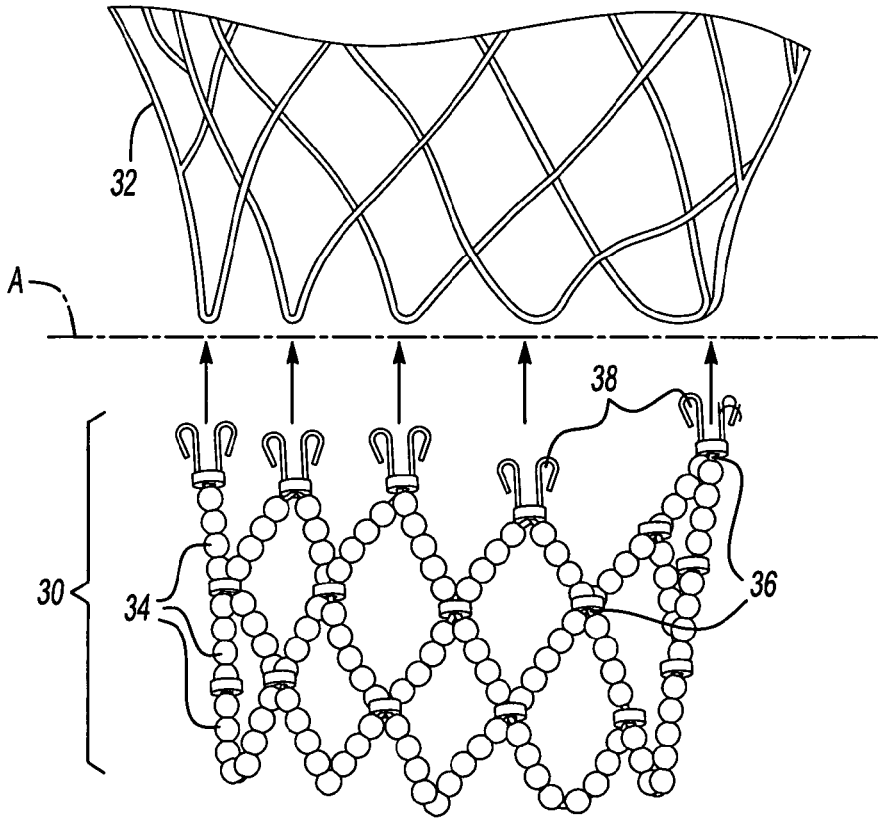
FIG. 5 is a partial front view of yet another example basketball net according to this invention.

Referring to FIG. 5, another example beaded net assembly 30 includes a separate section attachable to a basketball net 32. The beaded net assembly 30 includes a plurality of beads 34 supported on an elastic net material 36. The beaded net assembly 30 is adapted to attach to and detach from the basketball net 32. The basketball net 32 may be any standard basketball net.

The beaded net assembly 30 attaches to the basketball net 32 by cutting away a portion of the basketball net 32 along a cut line A. The beaded net assembly 30 is then attached at the cut line A to the remaining portion of the basketball net 32. The beaded net assembly 30 may also be attached to the basketball net 32 without destroying any portion of the basketball net 32. This may be accomplished by including attachment hooks 38 to the beaded net assembly 30 for attachment to the basketball net 32. It should be understood that other attachment means are within the contemplation of the present invention. A logo banner 18 such as the example shown in FIG. 4 may also be employed within this example. Once the beaded net assembly 30 is attached to the basketball net 32, the net assembly functions in the same manner as described above with reference to FIGS. 1, 2, 3 and 4.

That the foregoing description shall be interpreted as illustrative and not in a limiting sense is thus made apparent. A worker of ordinary skill in the art would recognize that certain modifications would come within the scope of this invention. For that reason, the following claims should be studied to determine the true scope and content of this invention.

What is claimed is:

1. A snapping basketball net comprising:

a first net portion;

a second net portion attached to said first net portion at an end of said first net portion, wherein said first net portion comprises a material more elastic than said second net portion; and a plurality of slideable members supported on said first net portion that produce a desired sound in response to a basketball passing through said first net portion.

2. The snapping basketball net as recited in claim 1, further comprising a logo banner supported on one of said first net portion and said second net portion.

3. The snapping basketball net as recited in claim 1, wherein said first net portion expands and retracts in response to said basketball passing through said first net portion.

4. The snapping basketball net as recited in claim 1, further comprising a plurality of retainer members for maintaining said plurality of slideable members in a plurality of diamond shaped rows.

5. A snapping basketball net, comprising:

a net portion comprising a plurality of interconnected net segments, wherein said net portion comprises a first material and a second material and said first material is more elastic than said second material; and a plurality of beads supported on each of said plurality of interconnected net segments of said first material, wherein said plurality of beads produce a desired sound in response to a basketball passing through said net portion.

6. The snapping basketball net as recited in claim 5, wherein said first material of said net portion expands and retracts in response to said basketball passing therethrough.

7. The snapping basketball net as recited in claim 5, wherein said plurality of beads knock against one another to produce said desired sound.

8. The snapping basketball net as recited in claim 5, wherein said plurality of interconnected net segments are arranged in a plurality of diamond shaped rows.

* * * * *